United States Patent [19]

Zur

[11] 4,188,677

[45] Feb. 19, 1980

[54] LOUNGER BED AND ADJUSTABLE BODY SUPPORTING ASSEMBLY

[76] Inventor: Henry C. Zur, 10 W. Griswold Ave., Phoenix, Ariz. 85021

[21] Appl. No.: 855,843

[22] Filed: Nov. 30, 1977

[51] Int. Cl.[2] ..... A61G 7/10

[52] U.S. Cl. ..... 5/66; 5/68; 5/412; 5/63

[58] Field of Search ..... 5/61, 63, 66–69, 5/91, 92, 322; 297/DIG. 10

[56] References Cited

U.S. PATENT DOCUMENTS

| | | | |
|---|---|---|---|
| 1,959,920 | 5/1934 | Kaiser | 5/322 |
| 2,766,463 | 10/1956 | Bendersky | 5/92 |
| 3,094,713 | 6/1963 | Wise | 5/67 |
| 3,392,412 | 7/1968 | Aymar | 5/327 R |
| 3,419,920 | 1/1969 | Maddox et al. | 5/91 |
| 3,434,165 | 3/1969 | Keane | 5/61 |
| 3,485,240 | 12/1969 | Fountain | 5/61 |
| 3,763,507 | 10/1973 | Propst | 5/100 |
| 3,879,772 | 4/1975 | Pol | 5/68 |
| 3,972,081 | 8/1976 | Stein et al. | 5/68 |
| 4,087,874 | 5/1978 | Callaway et al. | 5/343 |

*Primary Examiner*—Casmir A. Nunberg

[57] ABSTRACT

An adjustable body supporting assembly composed of a foundation and panel on which an assembly of pivotally connected plates rests, being mounted on said foundation with its centrally positioned part and provided with the means to adjust each plate in relation to its adjacent plate. A mattress is forming the top of the bed being held securely in position by encompassing plates of the said assembly. The foundation type panel is distinguished by its compact and simplified construction representing in effect an unbending lower foundation usually associated with regular assemblies composed of foundation and mattress. Means such as powered activators for the adjustment of the plates on which the mattress is mounted are incorporated in the foundation panel.

In a more refined embodiment the invention encompasses a separate head-part, adjustable in relation to the backpart, and an additional main feature of the invention is the operation of the various movements with one single power source such as a compressor, making it possible, together with the simplified construction of this invention, to reduce production costs substantially, and make this important item of personal comfort available at lower prices.

25 Claims, 7 Drawing Figures

FIG. 5
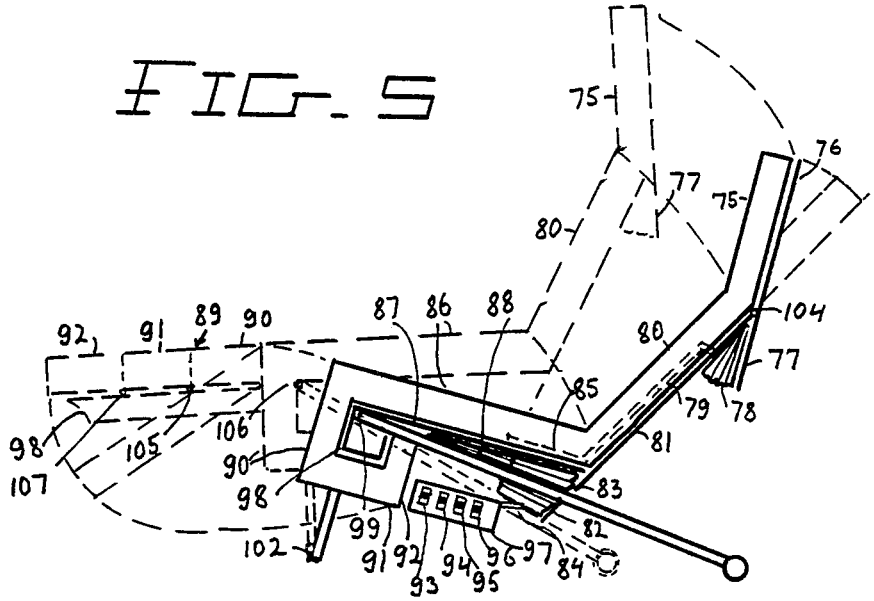
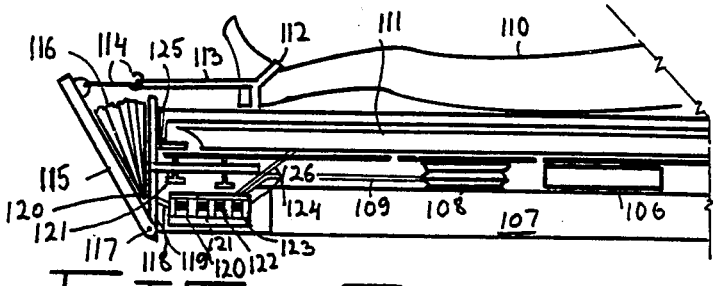
FIG. 6
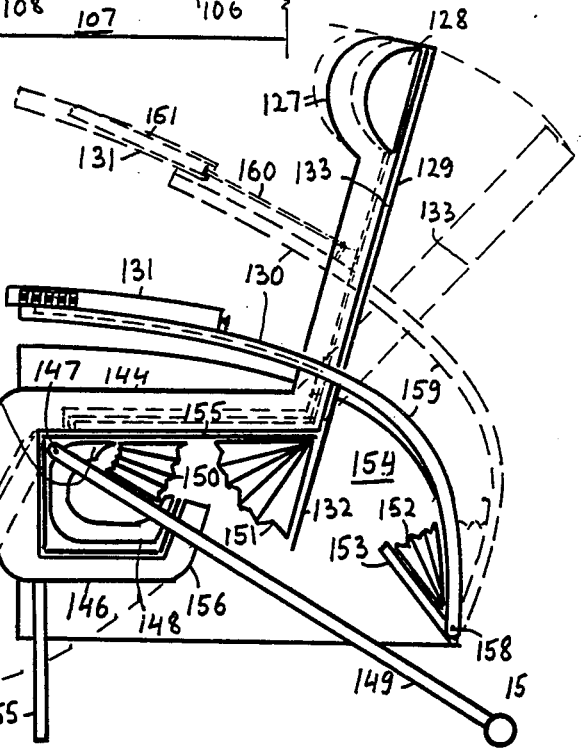
FIG. 7

LOUNGER BED AND ADJUSTABLE BODY SUPPORTING ASSEMBLY

HISTORY OF THE INVENTION AND PRESENT STATE OF THE ART

Lounger-Beds with adjustable supports are being built for a long time and have been in use mainly to provide adjustable comfort for sick and handicapped persons. Originally the metal frames used for beds were adapted by adding some pivotal sections and operating them by hand or later by a manually turned screw. In time the manual screws were replaced by electric motor driven screws and fixed controls evolved into movable remote controls.

However, while certain structural changes and improvements were made, the basic form has remained more or less static formed by a cumbersome and costly metal structure, usually associated with machinery and being highly visible, many potential users have been turned off, both by the looks and the price originating in such complex structure.

The present high cost of production and the machinery type form do no only make the product unlikable and unattainable, but prevent the wide use of adjustable beds by many otherwise potential users. For the advent of television in particular is causing many viewers to assume positions detrimental to healthy body posture while watching television from their beds, ultimately causing harm to spine and posture. Many other activities such as reading and conversing require an adjusted body posture. And for many sick or handicapped people adjustable beds are a must, as evidenced by the fact that all beds in hospitals are adjustable.

Presently made adjustable beds have some additional important disadvantages. One is the absence of a separate adjustment of the head in relation to the back, causing many people to place a number of pillows under their head while watching TV or reading. This in turn results often in falling asleep in such unproper and health detrimental position of a sharply bend head. An adjustment by remote control is easier than rearranging pillows.

Another disadvantage of presently built adjustable beds is the fact that mattresses are not held securely on the supporting assembly and are apt to move out when supports are adjusted for height, restrained mostly by a "U" type fixture connected to the foot end. This present fixture does not look good and does not restrain the mattress from raising in the center.

A very important disadvantage of presently built beds is the use of a separate power movement for each adjustable feature, usually a screw type drive with an electric motor. This is a handicap to multi-featured adjustable beds, as every additional feature required such addition of cost and weight and serves as restraint to the development of low cost, multi-featured adjustable beds. So far only one type of two-feature bed is built, but both features, back and knee have to be operated together, as the motor activates both features at the same time, in effect not producing an separate adjustment for the different body parts.

OBJECTS OF THE INVENTION

With the foregoing state of the art in mind the invention has the following objectives:

1. To provide a simplified adjustable body supporting assembly in order to reduce cost and make it attainable to more people;
2. To provide an adjustable assembly with more adjustable features;
3. To provide such adjustable assembly with a simplified means of operation;
4. To provide such an adjustable assembly with a simple and secure means of holding the mattress in position irrespective of the movements of supports for adjustment of position by providing the mattress with a means to insert the body supports;
5. To provide such an adjustable assembly with the additional feature of adjustable headrest by inserting an inflatable bladder on the upper portion of the backrest or dividing the backrest into two transverse parts and providing the upper part with a separate means for adjustment in relation to the lower part.
6. To provide such adjustable assembly with a simple foundation type panel serving as base for the body supporting assembly mounted on it and to place between that panel and the movable parts of the body supporting assembly inflatable bladders for adjustment together with controls, conduits and a source of fluid such as an compressor;
7. To provide such adjustable assembly with wheels and means for manual or powered mobility such as electric motors;
8. To provide such adjustable body supporting assembly with individually adjustable leg supports, for adjustable elevation and slant;
9. To provide such leg supports as separate and parallel individually adjustable supports and cover them or the whole assembly with a flexible and expanding material or mattress to bridge the gaps between individual adjusted supports;
10. To provide such assembly with an expandable leg or wheelbase, capable to retract for sitting or moving;
11. To provide an attachable traction device capable to operate by pressure exerted with an inflatable bladder, and to cause alternating strain and relaxation by inflation or deflation and in any required or preset timing.

SUMMARY OF THE INVENTION

The foregoing objects are achieved by providing a base which includes legs that engage the floor, a frame supported by said legs and surface members stretching from one side of the frame to the other side onto which individually inflatable bags are positioned at supporting points and a body supporting assembly resting with its bottom members on said inflatable bags. If the horizontal position of the body supporting assembly is to be changed in relation to the base, inflation and deflation of one pair of inflatable bags at an end side will affect a longitudinal adjustment of the respective side, inflation and deflation of a combination of 2 individually inflatable bags one out of each pair comprising the inflatable support at a long side, will affect a transverse adjustment of the body supporting assembly, and the inflation and deflation of the combination of all 4 bags will provide adjustment for height of the whole body supporting assembly.

Similarly, the angle of sections of a sectionally divided body supporting assembly could be adjusted by inflation and deflation of a combination of the inflatable bags on which the respective parts rest. To provide adjustment of the body supporting assembly in relation to the base combined with adjustment of the different sections of a divided body supporting assembly a panel linked to the base is interposed between the base and the body supporting assembly. The inflatable bags positioned on the base effect adjustment of the panel, and inflatable bags positioned between the panel and the back section of the body supporting assembly at its pivotal connection to a middle support mounted on said panel and between the panel and the knee support at its pivotal connection to the other side of said middle support provide for adjustment of said back and knee support relative to said middle support. An additional inflatable bag positioned at the pivotal connection of a leg support and the second side of said knee support, and supporting said leg support while resting against a member extending at a right angle downward from the knee support, causes adjustment of said leg support relative to the knee support by inflation and deflation.

It is evident that by using a combination of inflatable bags the occupant can assume a great variety of positions as may be required for comfort, for functions and for care. A continued inflation of bags positioned between the base and the interposing panel will provide a swining movement of that panel and the body supporting assembly mounted on said panel when the panel is linked to foot near portion of the base, and this will move the occupant into vertically elevated positions of sitting and standing up. Similarily, a deflation will cause the position of the occupant to change from standing up to sitting, reclining and lying down.

Providing a mattress like assembly of inflatable bags over the body supporting assembly covered with a flexible layer improves the comfort of the occupant by giving adjustment of pressures at individually selected parts and when outfitted with a timer mechanism, a sequencial inflation and deflation to provide relief from pressures and their effects.

On a simplified version one or two mattresses may be used, although in most cases one good mattress will provide all the resilent comfort required. The mattress may be fitted with transvers pockets on each side, permitting insertion of support plates into the mattress which can be turned around or with a zipper at the head side, permitting both the placement of an inflatable headrest, and the insertion of a complete assembly of pivotally connected plates serving as adjustable body supports, except for the plate in the center, which is mounted to the foundation panel. When the mattress is fitted with transverse pockets, the plate assembly is inserted from both ends into the pockets, thereby loosing their visibility and holding the mattress securely in position, irrespective of the adjustable movements.

The assembly of plates can be made in a sandwich type form by gluing a flexible material as inner ply of the plates and thus connecting one plate to the other, or by fastening a flexible material from one or both sides to the plates, whereby the flexible material serves as hinge. Thus heavy framing or hinges can be eliminated together with the accompanying noise.

In another modification of the invention, the plates forming the back and knee parts of the assembly are prolonged downward, and extend below the pivoting point. Pressure from an inflatable bladder placed between the downward extending part and the panel part which forms the center part of the plate assembly, or on which the centerpart of said plate assembly is mounted, is pushing the downward extention down and thus the support up in relation to the foundation panel and serve for adjustment by inflation or deflation. The support plates are less apt to move into the counter-pressure direction then in the simplified embodiment, where springs may be required to secure the supports.

An additional bladder placed similarly between a downward extention of the upper half of a divided back plate and the lower half of the back from behind, will cause the headpart to move upward in relation to the back and thus serve effectively for the adjustment of the head for activities such as TV viewing or reading.

Another additional bladder placed between as right angle extention of either the knee or legrest and the other respective support will provide by inflation or delation for adjustment of the legrest in relation to the knee.

The above mentioned modification of the invention whereby the back and knee plates extend downward, can in the above simplified manner of a relative inexpensive foundation panel be modified to be operated with screwdrive electric motors which are pivotally mounted to such extention or to a member secured to said back or knee plate on one side and on the other side pivotally secured to a head or foot part of the foundation panel. This also is possible because of the improved and simplified means of construction as shown in this invention and will lead to the reduction of cost and price. Ultimately lower cost and price will be achieved by the fluid powered versions which can at the same time power additional features at little extra cost.

One additional important feature could be provided for adjustable positioning or elevation of each leg separately, by two parallel mounted legrests, each powered by an inflatable tube mounted to the bottom and extending from the knee support to below the legsupport whereby increased inflation the pivoting legrest is elevated until it is aligned with the kneesupport. A flexible mattress or expanding covering will serve to bridge gaps between separately adjusted supports and to cover the whole assembly.

A simplified but versatile traction device is an additional novel feature, capable to operate by the source of fluid under pressure operating the lounger-bed. The device will be attached to the supporting assembly structure at the required position, the human body part tied to a movable member of this traction device, and the required strain or relaxation caused by inflation or deflation of an bladder pressing against said device-member to any selected position, or selectively causing alternating strain and relaxation in a selected or sequented manner, or progressively increasing the strain. With this multi-featured traction device, a more progressive and less painful traction system is provided over the existing art.

Another important novel feature using the fluid under pressure as power source is provided with the power operated extendable leg or wheelbase, required to retract for moving and turning purposes. This novel feature is accomplished by mounting the rearward extending legs in a pivoting manner just below the pivoting point of the leg support to the knee support, and resting on said rearward extending legs of the base the inflatable bladder serving for adjustment of the knee support relative to the base while inflating the bladder for more horizontal positioning of the knee support for sitting purposes, pressure is exerted against the rearward extending legs and causes them to contract, with the fixed front legs of the base resting on the floor, in a manner similar to the opening of scissors. Similarely, when the bladder is deflated for reclining purposes of the knee support serving as seat part, the rearward extending legs expand outward and increase the leg or wheelbase providing increased stability for horizontal positions. In a more refined embodiment of this invention serving for wheel chair purposes a expanding wheelbase with scissor type horizontal elements is expanded and retracted by means of inflating or deflating tube like bladders operating in part against counteracting springs. This in itself is an important advancement of the art, as the use of fluid under pressure to operate with simple bladders various features, permits the building of relative light multi-featured wheeled loungers or beds, whereas under the present art wheelchairs are built with heavy weight and high cost screw type electric motors or hydraulic cylinders for each feature

SHORT DESCRIPTION OF DRAWINGS

FIG. 5 is a view of a lounger type embodiment with retractable wheel and legbase;

FIG. 6 is a view of part of the adjustable assembly with the attached traction device;

FIG. 7 shows a lounger type embodiment with adjustable side elements and exdending armrests.

DESCRIPTION OF PREFERRED EMBODIMENTS

Figure 1:
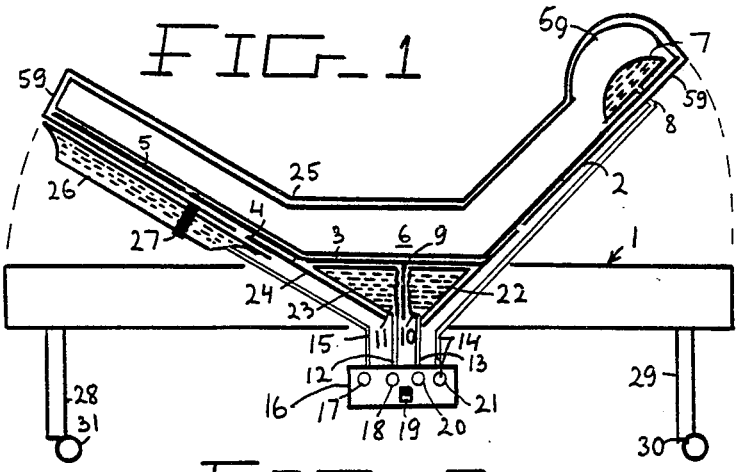
FIG. 1 is a schematic view of a simplified embodiment of this invention with the operating parts shown in section.

A multi feature adjustable lounger bed of novel design is shown in FIG 1. A foundation like base panel 1, which can be put into regular bedframes or supported on its own legs 28,29 and the casters 30,31 serves to support an mattress like upper part 25 supported by pivotally connected panels 2,3,4,5 which are inserted within the covering 59 into transverse openings as shown in more detail in FIG. 2 as 34, so as to make the structural and operating parts less visible, and to make the upper part look like a regular mattress, while actually including the adjustable elements for back and knee and the novel adjustments for head and legs.

A sandwich type formation with a flexible material as the center layer serves in this embodiment for the pivoting panel assembly composed of the back panel 2, the middle panel 3, the knee panel 4 and the leg panel 5. The outer layers 60 encompass the flexible layer 24 shown here as serving for the pivotal connection the middle panel 3 to the knee panel 4. An inflatable bladder 7 is positioned on the upper portion of the backrest 2 and serves by inflation or deflation for adjusted elevation of an occupants head in relation to said backrest. The bladder 7 is connected by conduit 8 to the control and valve 14 on the control board. Pushing said control to an "open" position and activating the fluid flow in the desired direction by means of the three position control 19 will provide the desired inflation or deflation.

An extention 22 of the back panel 2 which is pivotally mounted to the middle panel 3, is extending downward into a recess divided by member 9 serving also as transverse transom of the foundation type base panel 1. A bladder 10 positioned between said extention 22 and the bottom side of the middle panel 3, serves for raising or lowering the back panel 2 by inflation or deflation provided from a fluid source through conduit 13, control and valve 20 on the control panel. Similarely, bladder 11 together with conduit 12 and control and valve 18 serves for adjustment of the knee panel 4 in relation to said middle panel 3 by means of the pressure extended on the extention 23 of said knee panel 4.

A tube like bladder 26 is shown here supporting the leg panel 5. The tube itself is mounted onto the bottom of the knee panel and is held securely by holder 27 so as to extend from a folding position, which permits the adjustable bending of the leg as shown in FIG. 1, to a straight outward position in direct alignment with the knee panel when inflated. Inflation and deflation of bladder 26 through conduits 15 and control and valve 17 will provide any desired positioning of the leg panel.

Figure 2:
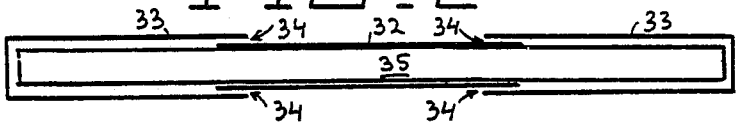
FIG. 2 is a sectional view of the mattress cover with the transverse openings for insertion of the support panels.

A covering and mattress 35 is shown in FIG. 2. The covering is provided on both the upper and the lower side with transverse openings 34, serving to insert the back panel into the direction of the head, and the leg and knee panel into the direction of the foot. The part of the cover covering the center part 32 is shown extending below the cover of the transverse openings 33. Being provided with transverse openings on both sides, the mattress can be reversed.

Figure 3:
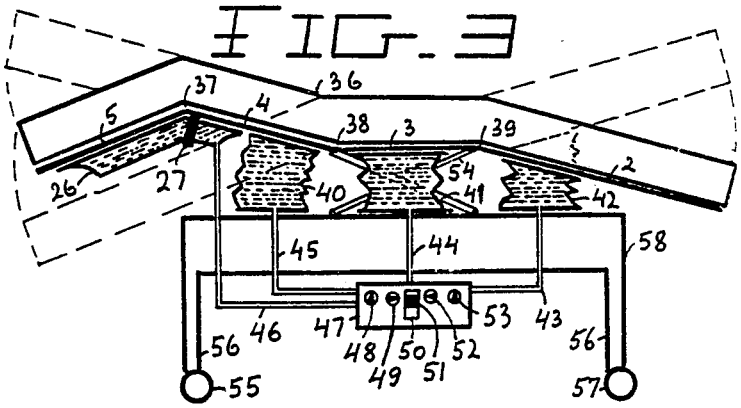
FIG. 3 is a shematic view of a hospital type or transporter embodiment with the operating parts shown in section.

A modified embodiment for the assumption of various positions as may be required for special treatment and care is shown in FIG. 3. The base panel 58 is more compact and provided with greater wheels 55,57 for better movement. A mattress like body supporting assembly 36 has a back panel 2 pivotally mounted at 39 to middle panel 3. A knee panel 4 is pivotally mounted at 38 to said middle panel at its other transverse side, and a leg panel 5 is pivotally mounted at 37 to the other transverse side of said knee panel. An inflatable bellow type bladder serves for elevation of the middle panel in relation to the base panel. The bellow type bladder 41 is connected by conduits 44 to the fluid source by means of control and valve 52. The middle panel is securely held to the base panel by means of scissor type links, which can be locked to a desired position 54. A bellow type bladder 42 is resting on the base panel 58 and supporting the back panel 2. The bladder 42 is connected by conduit 43 and control and valve 53 to the source of fluid, and since the middle panel is in an elevated position, an deflation of bellow 42 will cause the back panel to slant downward, and inflation will cause the back panel to assume any desired position of elevation. Similarely, bellow 40 with conduit 45 control and valve 4 will cause by deflation to lower the knee panel 4 and by inflation to elevate said panel to a selected position. The tube like bladder 26 is supporting the leg panel 5 in a bend position when deflated and raises said leg panel in relation to the knee panel, when inflated to a selected position. The bladder 26 is connected to the fluid source by conduit 46 control and valve 48, and inflation or deflation is caused by pushing the control knob 51 in the desired direction. This method of operation eliminates the need for electrically operated parts in case of danger from oxygen, but electrical control buttoms serving each bladder in both directions will simplify the controls.

Figure 4:
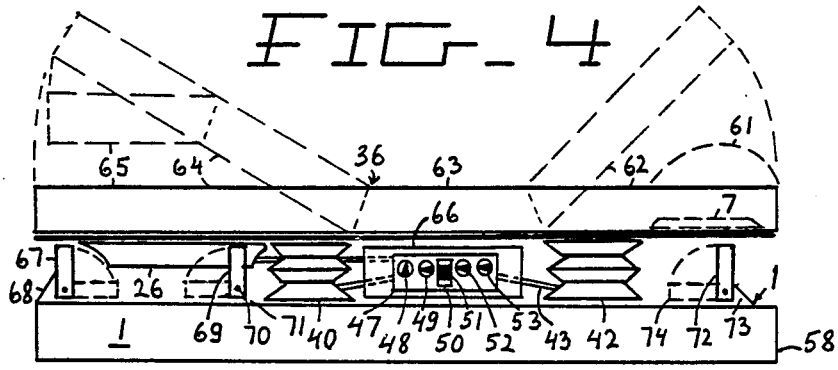
FIG. 4 is a shematic view of a multi purpose embodiment with locking devices for horizontal positions.

A modification of the special treatment and care lounger bed described in FIG. 3, is shown in FIG. 4. The middle panel 63 of the body supporting assembly 36 is raised by means of member 66 positioned on each side between said middle panel and the base panel 1. A turnable member 72 is pivotally mounted to part 73 mounted for pivoting purposes on the base panel. The turnable member 72 is shown locked into an upright position to stop a downward movement of the back panel 62, and align said back panel with the fixed middle panel for regular use as an upward adjustable bed. However, when the turnable member is turned downward into a flat position as shown in 74, the back panel can be adjusted downward by means of deflation of the bellow type bladder 42. Similarely, the knee panel can be secured into a regular aligned position with the middle panel by means of turnable member 70 which is pivotally mounted to the base panel at 71, and the leg panel 65, secured by means of the turnable member 67 pivoted to the base panel at 68. The bellow 40 with conduit 45 and control 49 serve for the adjustment of the knee panel to a selected position, and the tube like bladder 26 with conduits 46 and control 48 serves for adjustment of the leg panel in relation to the knee panel.

This embodiment as shown in FIG. 4 when fitted with a handheld remote control can serve for many care purposes and provide, especially when fitted with the additional feature of raising the whole body supporting assembly by means of an inflatable bladder below the middle panel as shown in FIG. 3, for many hospital purposes for which at present different beds are needed to provide different features.

The embodiment as shown in FIG. 3 can both serve as multi feature hospital bed, and in a more compact form as a kind of transporter, to transfer persons, to move them outside and sit them up, to raise the transporter to bed height for easy transfer of patients, and to help recuperating persons to get up, from a position adjusted for such purpose. The transporter can be provided with its own fluid source in the form a small airpump powered from a battery, or moved by an attendant and hooked up on location and with the additional feature of the adjustable headrest of this invention.

Turning now to FIG. 5 a more compact version of the lounger bed is shown in position for reclining. The headrest 75 which is formed by the upper portion 76 of the divided back panel 81 is pivoted by means of spring loaded hinges 104 to said back panel and is adjusted forward by means of inflating the bladder 78 positioned between said back panel and the extention 77 of the headrest panel 76. Conduit 79 leads to fluid source through control 96 on control box 97. When operated by a hand held or side arm fixed remote control, the valves and controls in the box 97 are activated by electric or other impulses. Similarly, the back panel is adjusted in relation to the combined middle and knee panel 88 by means of bladder 83, conduit 84 and control 95.

This lounger bed is provided with a relative short base for easier movement and better turning by having a divided support structure serving as expandable base. The front support 102 is fixedly mounted to the front part of the combined middle and knee support serving as seating portion. When not provided with casters, or when provided with securable wheels, this front support will serve as lower pivoting point for the lounger bed. The rear support is extending diagonally upward, and is pivotally mounted to the front of the seating portion, with a bladder positioned on said support structure 100, below the panel 87. When bladder 88 is inflated it causes a swinging movement to the whole lounger assembly by pressing on the rear support structure 100, causing it to move toward the front support and thus effectively shortening the base, and at the same time move the front of the seating portion 86 forward and a little bit upward, while raising the back of the seating portion to any desired position of eleva- such as may be required for desk work, viewing and other purposes.

This upward movement can be continued by further inflation of bladder 88 and reach a semi vertical position to facilitate the exit or sitting down of persons in need of such additional feature. The bladder 88 is served by control 94 of box 97 directly or by remote control.

The legrest 89 of this modification of the invention is made up of pivotally hinged members 90, 91, and 92, and is provided with a tube like bladder extending from below the seating portion in a manner which causes the inflation of bladder 98 to extend the legrest members forward. A partial deflation will cause the legrest members to a lower position, but still providing an uninterrupted continuous body support, and a further deflation will cause the tube to fold permitting the legrest members to fold down and inward by means of the spring loaded hinges 105, 106 and 107 serving as the pivoting connections of said legrest members and as pivoting connection to the seating portion of the lounger.

Turning now to FIG. 7, a further modification of the previous embodiment is shown with certain parts in section. The adjustment of the headrest is accomplished here by the inflatable bladder 128 positioned at the upper part of backrest 133. An extention of the back panel 129 shown as 132 is pressured outward by bladder 151. This bellow type bladders is interposing between said extention and the bottom of the rear seating portion 144 against panel 155. Inflation of said bladder causes the backrest 133 to swing forward in relation to the seating portion 144, while delation causes the backrest to swing rearward up to a semi aligned position with the seating portion which when lowered, moves the rear support structure further backward and thus effectively increase the leg and wheelbase, a very important requirement for more horizontal reclining. This is achieved by deflation of the bladder 150, positioned on said rear support structure and against panel 155 of the seating portion, and inflation of this bellow bladder is causing an elevating movement of the seating portion, pivoted at 147. The legrest composed of members 145, 146, and 156 is shown folded downward, with the tube like inflatable bladder 148 folded inward. Inflation of said tube like bladder which is mounted to the bottom of the front seat portion at 157, will cause the tube to expand against the spring held retracted legrest members and to elevate the uninterrupted continuation of the body-supporting assembly to a selected position.

A further important novel feature is shown in this embodiment by the mode of pivoting armrest side elements to the lounger structure 159 which is fixedly connected with the seating portion, and the means of raising said armrests by inflating a bladder positioned between the downward extentions 159 of said armrests, and extending said armrests forward by means of a fluid operated cylinder as shown at 161 and piston 160.

These extendable armrests as shown in FIG. 7 can be provided with multiply cylinders, one extending out of the other, and thus provide a more extendable support, which can serve well many persons suffering from weak legs, as these develop usually strong arms, and serve to support them on their arms, or below the arms for transfer, standing up or sitting down. Similarly, the pivoting and extendable side elements can serve as siderails on the hospital type beds.

Another important feature of novel design is shown in FIG. 6, as traction device utilizing the same source of power as provided for the other features of the invention, and thus complementing the hospital type and care beds with this important device at relative low cost. The device consists of a mounting arrangement with horizontal extending member 121 positioned below a body-supporting panel and secured with screws against said panel, while upper horizontal member 125 is positioned above said body support. Both horizontal members 121 and 125 are mounted on to a vertical member 120 to which another semi vertical member 115 is pivotally mounted at 117. An inflatable bladder 116 is positioned between said members 115 and 120, and causes by inflation member 115 to move outward. A harnessing assembly 112 is shown positioned and secured to human body part 110 at one side at at the other side attached to a hook 114 connected to member 115 at its upper end.

Inflation of said bladder 116 can be adjusted by means of control 120 on control box 126 for the required strain, or by means of a pre-set control system to alternating strain and relaxation, and also as all other features, by remote control.

What is claimed is:

1. An adjustable body supporting assembly comprising a. a base;

b. a middle body support fixedly mounted in a raised position on said base;

c. a back support pivotally connected to said middle support a knee support, pivotally connected to the other side of said middle support, and a leg support pivotally connected to the other side of said knee support;

d. means to secure or release said pivoting supports in a raised position aligned with said raised middle support such as holding devices pivotally mounted below said supports which can be turned aside to permit downward movement of a body support resting on such holding device; and wherein the same means serving for the adjustable elevation of a support panel from its aligned position, serves also for the adjustable downward movement of the body support panel from its aligned position with said middle support.

2. The assembly of claim 1, wherein the means for adjustment of the pivotally connected body supports takes the form of inflatable bellows, which when combined with the lowered holding device provide for both upward and downward adjustment of a pivoting body support from its aligned position with the middle support, and which, when said holding devices are put into a position holding a pivoting support in an aligned position with said middle support, serve for the regular elevating adjustment of said support.

3. The assembly of claim 1, wherein an inflatable bladder is positioned between the middle panel and the base panel and serves for adjustable elevation of said middle panel by inflation or deflation, and whereby the whole assembly of body supporting panels can be raised, and the back or knee and leg panels be lowered to a slanting position as may be required for various purposes or treatment.

4. The assembly of claim 1, wherein an inflatable bladder is positioned on each transverse side of said middle panel, leaving the center space free when required for toilet or bed pan, and serves in addition to the adjustable elevation of the whole assembly, for any transverse slanting as may be required by means of selectively inflating one of the bladders positioned at the sides of said middle panel.

5. The assembly of claim 1, wherein the middle panel is secured to the base panels by a linkage such as scissor type connections, and locable to a selected position, causing the middle panel to assume a selected slanting position in the longitudinal direction of the lounger bed, and whereby the body supporting panel assembly can assume a more vertical position to facilitate the entry or exit from or to the lounger bed by handicapped persons.

6. The lounger bed of claim 1, together with conduits, valves, controls and a source of fluid under pressure such as air pump or water main, serving as operating system for the various features and movements, and providing manual or remote control, selective or timed and sequented operation by inflation or deflation of any selected bladder.

7. The operating system of claim 6, together with means to facilitate the deflation of bladders such as reversing the flow by electric or mechanical means.

8. The operating system of claim 7, wherein wherein the insertion of fluid and exhaustion is supplied by outside sources such as air or water mains, capable to provide for the adjustment and movement of the various features, together with fluid operated controls, whereby the operation of said assemblies can be without any parts such as spark causing electric devices to avoid potential danger in particular when oxygen is used.

9. The assembly of claim 1, wherein a pivoting support together with its flexible connection to the adjacent support is formed from plastic materials as one piece.

10. The assembly of claim 1, wherein the whole assembly of pivoting supports together with their pivotal connections is formed from plastic materials as one piece.

11. In a adjustable lounger or bed structure, wherein side elements such as side guards or armrests serving to provide elevated support are mounted for variable elevation to the lounger or bed structure by means such as pivoting connections, and the adjustment or elevation is accomplished by power means such as an inflatable bag positioned between a and said side elements.

12. The side elements of claim 11 wherein armrests are mounted for outward movement on said side elements and provided with the means to cause both forward and both backward retracting movements such as operation with fluid activated pistons in cylinders.

13. An adjustable body supporting assembly wherein the base takes the form of a fixed front support mounted to a seating portion acting as main structure and a rear part extending upward to the front of said seating portion and pivotally mounted there at a position paralleling a human occupants knee joint, together with means such as levers or inflatable bags to raise the back part of said seating portion in relation to the rear support part, causing a pivotal raising movement of the body supporting assembly to a forward inclined sitting or more elevated position, and at the same time shortening the distance between the fixed front support and the pivoting rear support and thus providing a shorter base for easier movement and turning of said assembly, and whereby the movement of the floor resting supports can be limited by providing only one support with wheels or a locking device on some wheels, and whereby providing said assembly with motorised means such as electric motors and air pumps a multi feature adjustable wheeled lounger is provided for handicapped persons, giving them a degree of mobility comfort to adjust horizontally for rest and capability to adopt certain elevated and forward inclined positions as may facilitate sitting at the table or be required for work at a desk.

14. The assembly of claim 1, wherein the back panel is composed of an upper and an lower portion, and the upper portion is adjustable in relation to the main back portion for adjustable positioning of the head, by means such as an inflatable bladder placed against an extention of one portion and the other portion near their connecting point.

15. In an adjustable lounger bed of claim 4, wherein a legrest composed of two or more pivotally connected members is extendable and retractable from its pivoting point on the knee panel by means such as push or a pull on scissor type assembly connected to said legrest, and whereby the leg rest forms an uninterrupted continuation of the whole body supporting assembly, can be adjusted as required, and can be retracted below the seating portion of the assembly.

16. In an adjustable lounger or bed, wherein a tube like formed bladder is mounted below the knee support panel and extends out below a leg panel to raise said leg panel from a folded down position to a position in alignment with the raised knee panel by inflation of said tube, and to fold said leg panel down or adjust to a desired position by inflation or deflation of said tube like bladder or adjustment and wherein the leg panel is composed of two or more pivotally connected members to each other is, and capable to fold down and below the knee portion of the lounger or bed, and to return to a raised and extended position providing an uninterrupted leg rest and body support assembly preventing the pressures causing interruppted blood flow and accompanying pains to certain portions of a persons legs due to the absence of continuous support and whereby persons suffering from heart and other diseases can position themselves with legs elevated over the level of their knees and in near alignment with their heart, while resting in the desired position of upper body and legs elevated.

17. The assembly of claim 13, wherein fixed supports are mounted to a wheelbase, capable to expand by means of scissor like extending arms, to provide a more extended base for more horizontal positions, and capable to retract to provide a more compact wheel base for uses such as fully motorised adjustable lounger beds, and provided with power means such as inflatable tubes in combination with springs for remote control or manuel operation.

18. An adjustable lounger or bed comprising body supporting panels and a base, a back panel pivotally connected to a a another supporting panel, and pivoting knee and leg panels and wherein built in adjustments for the head, back, knee and legs are provided as part of the assembly by a. an inflatable bladder placed at the head position on the back panel, adjusting the position of an occupants head in relation to the back support panel by inflation or deflation;

b. an inflatable bladder placed between the back panel or an extention of said panel and the base, near the pivoting point for adjustment of said back panel by inflation or deflation c. a third inflatable bladder placed betwwen said knee panel or an extention of said knee panel and the base near the pivoting point, for adjustment of said knee panel by inflation or deflation of said bladder;

d. a fourth inflatable bladder extending from and below the knee support under the leg support to provide for the adjustable elevation of the leg support in relation to the knee support and the upward slanting positioning of the leg in alignment with the raised knee support by selective inflation of said bladder and whereby ailing persons such as suffering from heart diseases can position themselves with their legs raised to the level of their hearts while assuming a position with their upper body elevated.

19. The lounger bed of claim 18, wherein the inflatable bladders serving for the adjustment of back and knee support panels are positioned in a recess below the middle panel and cause the movement of said panels by pressing against extensions of said back and knee panel, extending from these panels beyond their pivoting point downward into the recess below the middle of the assembly.

20. In an adjustable body supporting assembly wherein mattress is secured to the adjusting support panels by means of inserting one or more panels into transverse openings provided in the mattress or cover in order to create an inserted effect securing the mattress to the enveloped supports for their adjustable movement.

21. In an adjustable body supporting assembly of claim 4 comprising pivotally connected body support wherein the pivoting connection of the various supports of the assembly constitutes flexible material.

22. The assembly of claim 21, wherein the body supporting panels are made with one or more layers of the flexible material and one or more layers of panel forming materials.

23. The assembly of claim 21, wherein the pivoting panels and the flexible connections stretching between said panels are made from plastic material formed to the required shape.

24. The assembly of claim 18 wherein the built-in head pillow is positioned inside the mattress and its cover.

25. In an adjustable fluid operated bed like structure connected members, which are pressured apart by means of an inflatable bladder and produce a selective adjustable strain which is transfered to the patient's body part by means of a attachable harness extending from one of the two members of the said traction device, while the other member is attached to the adjustable body supporting assembly on which the patient is positioned for variable positioning, and whereby desired strain or relaxation can be administered in a selective or sequented or progressively increasing and decreasing manner, and whereby a fluid source operating the patients body supporting assembly can be utilized and complement the requirements for care of the patient.

* * * * *